US006533706B2

(12) United States Patent
Morrow

(10) Patent No.: US 6,533,706 B2
(45) Date of Patent: Mar. 18, 2003

(54) SYSTEM OF IMPACT MEASUREMENT AND DISPLAY

(75) Inventor: George S. Morrow, Green Mountain Falls, CO (US)

(73) Assignee: Tomorrow's Exerprizes, Mantou Springs, CO (US)

( * ) Notice: Subject to any disclaimer, the term of this patent is extended or adjusted under 35 U.S.C. 154(b) by 4 days.

(21) Appl. No.: 09/860,718

(22) Filed: May 18, 2001

(65) Prior Publication Data

US 2001/0044362 A1 Nov. 22, 2001

Related U.S. Application Data

(60) Provisional application No. 60/206,004, filed on May 19, 2000.

(51) Int. Cl.[7] ..... A63B 23/00

(52) U.S. Cl. ..... 482/1; 482/14; 482/15

(58) Field of Search ..... 482/1–9, 14–16, 482/23, 79, 80, 900, 901, 902; 434/247–248, 255–257

(56) References Cited

U.S. PATENT DOCUMENTS 5,125,647 A * 6/1992 Smith ..... 482/8
5,343,445 A * 8/1994 Cherdak ..... 368/10
6,181,647 B1 * 1/2001 Tipton et al. ..... 482/8

* cited by examiner

*Primary Examiner*—Glenn E. Richman
(74) *Attorney, Agent, or Firm*—David Pressman

(57) ABSTRACT

A system of monitoring impact stress, or acceleration forces on a user while exercising is disclosed. An exercise machine is equipped with sensing apparatus that measures the downward force exerted on the supporting surface by the lower extremities of the user. In this way, the corresponding impact forces are determined as a function of the user's body weight and communicated via a display monitor as "G-forces" or "Earth Gravity Units." This allows the user to keep exercise impact within limits desired by the user, a physical therapist, or other qualified professional.

8 Claims, 1 Drawing Sheet

SYSTEM OF IMPACT MEASUREMENT AND DISPLAY

CROSS-REFERENCE TO RELATED APPLICATION

Figure 1:
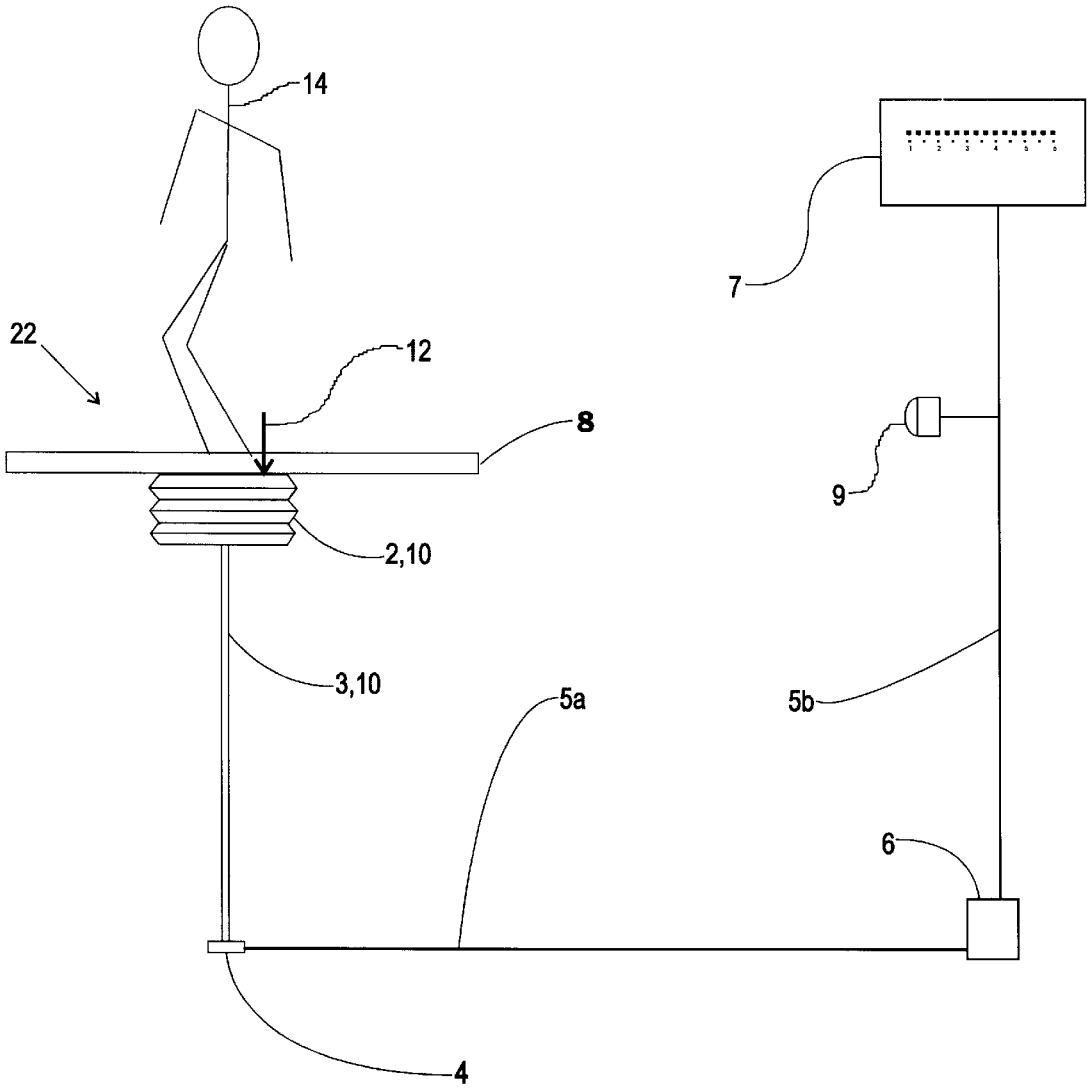

This application is entitled to the benefit of Provisional patent application Ser. No. 60/206,004, filed May 19, 2000.

BACKGROUND

1. Field of Invention

The present invention pertains to a system for measuring vertical impact, or maximum acceleration forces bearing on a person while exercising, and a display monitor that quantifies each such impact.

2. Description of Prior Art

Knowledge of impact forces on the body is very important, especially for a large and growing number of people who need low impact forms of exercise. This number includes many who have suffered trauma to the joints or other tissues, as well as arthritis, osteoporosis, and post surgical patients. Some of these patients cannot even bear the modest stresses of normal walking, yet need some form of aerobic exercise to maintain, or regain cardiovascular health.

Some types of aerobic exercise apparatus address part of the problem in that they provide a low-impact exercise; however, none of them provide the user with a quantification or measurement of how much impact they are subjecting themselves to. The most common of these low-impact devices include the venerable stationary bicycle, various water exercise apparatus, many and varied types of stair-climbers or "steppers", and a small but growing number of devices for plyometrics, or jump- training, which employ repeated bouncing or rebound exercise. [The present invention is to be utilized primarily with the last two types of equipment mentioned (steppers and rebound machines), which produce a weight-bearing type of aerobic exercise.]

In order to obtain accurate exercise impact information, the current standard is to use a device known as a force plate, which is a large and expensive apparatus which costs in the neighborhood of $30,000. Previously, spring-type strain gages were employed for the same purpose, though less exacting and much less convenient to use.

Neither the present inventor, nor any of his sources has heard of an exercise machine that includes any type of impact measuring device and display as an integral part of the unit. These sources include well-known professionals in the fields of sports medicine, physical therapy, and medical rehabilitation. They all agree that this useful innovation will make much needed information affordably available to them for the first time.

SUMMARY

A system of monitoring impact stress on a user's body while exercising on an exercise machine is disclosed. By measuring the downward force exerted on the machine's supporting surface, the system communicates the recurring impact forces to the user, so that the impacts can be kept within desired limits.

OBJECTS AND ADVANTAGES

The object of the present invention is to provide a simple, accurate, and inexpensive impact reading system for various types of stand-up exercise apparatus. It enables the user or clinician to easily determine impact forces during the exercise so that the forces may be immediately adjusted and kept within safe boundaries. With this invention, the maximum impact on the feet of the user is quantified and displayed in "real time" for each stroke (or step), employing an easily readable format. Besides a visual readout display, various types of alarm mechanisms may be employed to notify a user and/or therapist/trainer when a preset maximum impact is exceeded.

DRAWING FIGURES

FIG. 1 shows a schematic rendition of the Preferred Embodiment.

DESCRIPTION OF THE PREFERRED EMBODIMENT

As depicted schematically in drawing FIG. 1, the preferred embodiment of the present invention uses a fluid vessel, bladder, or bellows 2 that is filled with a fluid 10, connected with, and responsive to downward force 12 applied by the lower extremities of an upright user 14 on a pedal contact portion, or supporting surface 8 of an exercise machine 22. This fluid vessel 2 could be any form of fluid reservoir or fluid power device whose internal fluid pressure is responsive to downward force exerted on the supporting surface 8. (For purposes of this simplified illustration of the concept, it is useful to consider the fluid vessel 2 as a fluid-filled bellows as shown.) A length of tubing 3 is used to connect the fluid chamber with a fluid pressure sensor, or signal generator 4 that sends an appropriate electrical impulse to a signal processor 6 via signal transmission means 5*a*. The processor 6 is programmed to calibrate the pressure readings (as described below in the Operation section) and relay electronic instructions to a readout display 7 and an optional audible alarm 9 by way of signal transmission means 5*b* (The signal transmission means 5*a* and 5*b* are shown as electrical wiring, though either or both could be wireless).

OPERATION OF THE PREFERRED EMBODIMENT

Referring again to the schematic drawing FIG. 1, the operation of the invention is as follows: A downward (impact) force 12 applied to supporting surface 8 compresses fluid 10 contained in fluid vessel 2 and attached tubing 3. Signal generator 4 conveys the electronic signal value corresponding to that particular fluid pressure to signal processor 6 by way of signal transmission means 5*a*. The processor 6 computes the impact value as follows: First it stores a static pressure value (by sampling) before the user begins exercising. This same value is then recognized as 1 "g-force", or one normal earth gravity unit. The dynamic impact forces are then computed as a function of that static pressure value by dividing the dynamic pressure by the static pressure. This can be expressed by a simple formula: $Ig=Pd/Ps$, where Ig is the impact, or "g-force" in earth gravity units, Pd is the dynamic pressure, and Ps is the static pressure just described. The processor 6 constantly sends the appropriate electronic signals to readout display 7 via transmission means 5*b* (wired or wireless). The processor 6 can also be set to sound an audible alarm 9 when a selected impact force level is exceeded, thus gaining the attention of the user, therapist, or exercise coach.

NOTES ON OPERATION

It may be helpful to mention that the above described impact forces would have different physiological effects for similar readings if the person exercising were to come down on one foot at a time versus both feet at once. This fact, however, would presumably be obvious to any therapist who'd be in a position to prescribe impact parameters for a specific patient's exercise program.

Although the present inventor has demonstrated the above-described operation of the preferred embodiment with prototypes, they have been limited to exercise machines where the feet of the user do not leave the supporting surface. This system could possibly be adapted to such as a treadmill, but the formula and method for determining such impact readings would need more complicated mathematical elements that are not presently clear to this inventor.

CONCLUSION, RAMIFICATIONS, AND SCOPE

Thus the reader can see that this invention describes a practical and affordable system of impact measurement that is also helpful for both the clinician and patient/user alike.

While the above description contains many specifics, these should not be construed as limitations on the scope of the invention, but rather as examples of the preferred embodiment. Many other variations are possible. For example, although the above specification describes a visual "readout display" as the means of communication with the user, the means used could also audible, as in voice or other sound signal, or both audible and visual. Tactile communication could also be employed, for the hearing impaired, or in situations where audible alarms were undesirable. Vibrator-type technology, such as used on many pagers could be employed here.

An optional possibility could provide for a system of automatically dampening impacts that exceed the limits prescribed either by a therapist or the good sense of the user.

The impact display could also be used to measure leg extensor power, since the maximum impact as defined is equal to the downward force provided by the legs. This feature could provide valuable diagnostics for anyone from the elderly and frail to elite athletes, though the scale might have to be extended upward to 10 or more earth gravity units of impact for such use.

Thus the scope of this invention should be determined by the appended claims and their legal equivalents, rather than by the specific examples given.

I claim:

1. A method of monitoring impact stress generated when an exercise machine carries an upright user on a supporting surface, comprising the steps of:

a) measuring recurring maximum downward force exerted on the supporting surface, and b) communicating said measurement of maximum downward force to the user, so that the user may accordingly vary his activity, thereby limiting the impact stresses his body is absorbing.

2. A method as in claim 1 further comprising the step of displaying the maximum downward force as a function of the static weight of the user.

3. A method as in claim 2 further comprising the step of providing an audible alarm to signal the user when a variable preset downward force limit has been exceeded.

4. A method as in claim 1 wherein said supporting surface is supported by a fluid so that the downward force exerted on the supporting surface can be measured as a function of the fluid pressure.

5. A method as in claim 4 wherein said fluid is a gas, so that said fluid may be compressed, thereby absorbing energy and cushioning the user.

6. A method as in claim 5, further comprising the step of using an electronic signal generator, an electronic signal processor, and an electronic display to communicate the recurring maximum downward force to the user.

7. A method as in claim 6 wherein said electronic display shows a reading which is a function of the static weight of the user.

8. A method as in claim 5 wherein said gas is air.

* * * * *